US008939551B2

(12) United States Patent
Panchawagh et al.

(10) Patent No.: US 8,939,551 B2
(45) **Date of Patent: *Jan. 27, 2015**

(54) DIGITAL DROP PATTERNING DEVICE AND METHOD

(75) Inventors: Hrishikesh V. Panchawagh, Rochester, NY (US); Thomas W. Palone, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 204 days.

This patent is subject to a terminal disclaimer.

(21) Appl. No.: 13/432,056

(22) Filed: Mar. 28, 2012

(65) Prior Publication Data

US 2013/0257992 A1 Oct. 3, 2013

(51) Int. Cl.

| | |
|---|---|
| ***B05C 5/00*** | (2006.01) |
| ***B41J 2/005*** | (2006.01) |
| ***B05B 7/04*** | (2006.01) |
| *B41J 2/21* | (2006.01) |
| *B41J 2/14* | (2006.01) |

(Continued)

(52) U.S. Cl.

CPC ..... *B41J 2/0057* (2013.01); *B05B 7/0408* (2013.01); *B41J 2/2107* (2013.01); *B05C 5/00* (2013.01); *B41J 2/14* (2013.01); *B41J 2002/022* (2013.01); *B41J 2/175* (2013.01)

USPC ..... 347/54; 118/300; 347/21; 347/67; 347/65

(58) Field of Classification Search

None

See application file for complete search history.

(56) References Cited

U.S. PATENT DOCUMENTS

| | | | |
|---|---|---|---|
| 2,681,294 | A | 6/1954 | Beguin |
| 2,761,791 | A | 9/1956 | Russell |
| 4,109,282 | A | 8/1978 | Robertson et al. |

(Continued)

FOREIGN PATENT DOCUMENTS

| | | |
|---|---|---|
| EP | 1 358 931 | 11/2003 |
| EP | 1 193 066 | 5/2005 |

(Continued)

OTHER PUBLICATIONS

Meyer, Robert F., et al., "Universal Dripping and Jetting in a Transverse Shear Flow", Physical Review Letters 102, 194501, May 15, 2009.

(Continued)

*Primary Examiner* — Dah-Wei D Yuan
*Assistant Examiner* — Binu Thomas
(74) *Attorney, Agent, or Firm* — William R. Zimmerli

(57) ABSTRACT

A liquid dispensing system includes a liquid dispenser array structure that includes a functional liquid transfer region located between a liquid dispensing channel and a liquid return channel. A first liquid supply provides a carrier liquid that flows continuously through the dispensing channel, functional liquid transfer region, and return channel during a drop dispensing operation. Liquid dispensers, located on a common substrate, include a second liquid supply that provides a functional liquid, immiscible in the carrier liquid, to the dispensing channel. A drop formation device, associated with an interface of the supply channel and the dispensing channel, is selectively actuated to form discrete functional liquid drops in the flowing carrier liquid. A receiver conveyance mechanism and the functional liquid transfer region are positioned relative to each other such that functional liquid drops are applied to a receiver while the carrier liquid flows through the functional liquid transfer region.

9 Claims, 13 Drawing Sheets

(51) Int. Cl.
*B41J 2/02* (2006.01)
*B41J 2/175* (2006.01)

(56) References Cited

U.S. PATENT DOCUMENTS

| | | | | |
|---|---|---|---|---|
| 4,494,128 | A | 1/1985 | Vaught | |
| 5,371,529 | A | 12/1994 | Eguchi et al. | |
| 6,431,671 | B2 | 8/2002 | Matsumoto | |
| 6,443,551 | B1 | 9/2002 | Matsumoto | |
| 6,517,181 | B2 | 2/2003 | Yamamoto | |
| 6,719,423 | B2 | 4/2004 | Chowdry et al. | |
| 6,932,469 | B2 | 8/2005 | May et al. | |
| 7,237,887 | B2 | 7/2007 | Ueki et al. | |
| 7,328,982 | B2 | 2/2008 | Kusakari | |
| 7,458,672 | B2 | 12/2008 | Hirakawa | |
| 7,695,128 | B2 | 4/2010 | Tombs et al. | |
| 7,789,504 | B2 | 9/2010 | Tombs et al. | |
| 7,819,518 | B2 | 10/2010 | Rimai et al. | |
| 7,959,278 | B2 | 6/2011 | Regan et al. | |
| 2001/0015735 | A1* | 8/2001 | Matsumoto | 347/20 |
| 2002/0041311 | A1* | 4/2002 | Oishi | 347/68 |
| 2002/0051029 | A1* | 5/2002 | Yamamoto | 347/19 |
| 2003/0081082 | A1* | 5/2003 | Jeanmaire et al. | 347/74 |
| 2005/0172476 | A1 | 8/2005 | Stone et al. | |
| 2006/0051329 | A1 | 3/2006 | Lee et al. | |
| 2006/0163385 | A1 | 7/2006 | Link et al. | |
| 2008/0055380 | A1 | 3/2008 | Regan et al. | |
| 2009/0197977 | A1 | 8/2009 | Haeberle et al. | |
| 2010/0188466 | A1 | 7/2010 | Clarke | |
| 2010/0238232 | A1 | 9/2010 | Clarke et al. | |

FOREIGN PATENT DOCUMENTS

| | | |
|---|---|---|
| WO | WO 98/53946 | 12/1998 |
| WO | WO 03/004146 | 1/2003 |
| WO | WO 2007/042126 | 4/2007 |
| WO | WO 2009/004280 | 1/2009 |
| WO | WO 2009/004312 | 1/2009 |
| WO | WO 2009/004314 | 1/2009 |
| WO | WO 2009/004318 | 1/2009 |
| WO | WO 2010/110843 | 9/2010 |

OTHER PUBLICATIONS

Abate, Adam R. et al., "High-Throughput Injection With Microfluidics Using Picoinjectors", PNAS, Nov. 9, 2010, vol. 107, No. 45, 19163-19166.

* cited by examiner

DIGITAL DROP PATTERNING DEVICE AND METHOD

CROSS REFERENCE TO RELATED APPLICATIONS

Reference is made to commonly-assigned, U.S. patent application Ser. No. 13/432,044, entitled "DIGITAL DROP PATTERNING DEVICE AND METHOD", Ser. No. 13/432,052, entitled "DIGITAL DROP PATTERNING DEVICE AND METHOD", and Ser. No. 13/432/062, entitled "DIGITAL DROP PATTERNING DEVICE AND METHOD", all filed concurrently herewith.

FIELD OF THE INVENTION

This invention relates generally to the field of digitally controlled liquid ejection systems, and in particular to liquid ejection systems that eject a first functional liquid phase in a second carrier liquid phase.

BACKGROUND OF THE INVENTION

There is an increasing demand for patterned deposition of materials on receivers in traditional image and document printing and upcoming manufacturing applications. These deposition techniques can be broadly classified in non-contact printing systems and methods including, for example, ink jet printing and contact printing systems and methods including, for example, screen printing, flexography, offset lithography, and slot coating.

Ink jet printing has become recognized as a prominent contender in the digitally controlled, electronic printing arena because, e.g., of its non-impact, low-noise characteristics, its use of plain paper and its avoidance of toner transfer and fixing that is required in electrophotography based printing methods. Ink jet printing mechanisms can be categorized by technology as either drop on demand ink jet (DOD) or continuous ink jet (CIJ).

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop formation mechanism such that the liquid jet breaks up into drops of ink in a predictable manner. One continuous printing technology uses thermal stimulation of the liquid jet to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Micro-Electro-Mechanical Systems (or MEMS) devices are becoming increasingly prevalent as low-cost, compact devices having a wide range of applications. As such, MEMS devices, for example, MEMS transducers, have been incorporated into both DOD and CIJ printing mechanisms to control ink drop formation.

There is a constant need for patterned deposition of increasingly complex liquids using inkjet printing especially in applications for manufacturing of functional devices. Many of these complex liquids are loaded with fine particles and have much higher viscosities compared to typical inks used in inkjet. Thus, these liquids are difficult to eject to form drops. U.S. Patent Application Publications 2010/0238232 and 2010/0188466, both by Clarke et al., show a continuous ink jet system in which a liquid 2 in introduced by an injection mechanism into a liquid 1. Droplets of liquid 2 are formed in liquid 1 and then ejected into the air in the form of encapsulated drops. While this is a good way to create an inkjet system that can eject droplets of, for example, high viscosity inks that are difficult to otherwise eject by encapsulating the hard to jet liquid in another liquid whose properties are better suited to continuous ink jet; there is a need to be able to selectively inject the liquid 2 into liquid 1 so that liquid 2 is ejected only in the locations it is needed.

Contact type printing methods such as screen printing, flexography and offset lithography typically enable deposition of more complex liquids and give a better control on thickness of the deposited layers. These methods suffer from a limitation of no digital control in printed pattern because only fixed patterns can be printed. It is expensive to make changes to the patterns by changing plates or screens. Also, these methods do not allow change of pattern on the fly such as in inkjet printing.

In addition, it has long been known in the art to coat a uniform layer of a liquid by a contact transfer of a bead formed by liquid emerging from a slot die as shown in U.S. Pat. No. 2,681,294. This coating method allows deposition of uniform films having a range of thickness of complex materials. It is also possible to coat multiple layers of different liquids uniformly as shown in U.S. Pat. No. 2,761,791. U.S. Pat. No. 6,517,181 describes a method of coating a mixture of liquids using control mechanisms to control the relative flow of at least of the on liquids to vary the concentration of the mixture to form a pattern when coated on the receiver. Heretofore, however, the coating industry lacked the ability to transfer coat multiple liquids, where at least one of the liquids can be controllably dispersed in a carrier liquid to form discrete drops and to transfer the liquid drops to a receiver to produce a patterned deposition of the liquid.

SUMMARY OF THE INVENTION

According to an aspect of the present invention, a liquid dispenser array includes a carrier liquid (also referred to as a first liquid) and dispensed drops of a functional liquid (also referred to as a second liquid). A drop formation device causes a meniscus of the functional liquid breaks into drops of the functional liquid in a controlled manner. The carrier liquid transports the discrete drops of the functional liquid to a transfer location where the discrete drops of the functional liquid are transferred to a receiver.

According to another aspect of the present invention, a liquid dispensing system includes a liquid dispenser array structure and a receiver conveyance mechanism. The liquid dispenser array structure includes a liquid dispensing channel and a liquid return channel located downstream relative to the liquid dispensing channel. A functional liquid transfer region is located between the liquid dispensing channel and the liquid return channel. A first liquid supply provides a carrier liquid that flows continuously through the liquid dispensing channel, through the functional liquid transfer region, and through the liquid return channel during a drop dispensing operation. A plurality of liquid dispensers is located on a substrate that is common to the plurality of liquid dispensers. The plurality of liquid dispensers includes a liquid supply channel and a second liquid supply that provides a functional liquid to the liquid dispensing channel through the second liquid supply channel. A drop formation device is associated with an interface of the liquid supply channel and the liquid dispensing channel. The drop formation device is selectively actuated to form discrete drops of the functional liquid in the carrier liquid flowing through the liquid dispensing channel. The functional liquid is immiscible in the carrier liquid. The receiver conveyance mechanism and the functional liquid transfer region are positioned relative to each other such that the discrete drops of the functional liquid are applied to a receiver provided by the receiver conveyance mechanism while the carrier liquid continues to flow through the functional liquid transfer region, and through the liquid return channel.

BRIEF DESCRIPTION OF THE DRAWINGS

In the detailed description of the example embodiments of the invention presented below, reference is made to the accompanying drawings, in which.

DETAILED DESCRIPTION OF THE INVENTION

Figure 1:
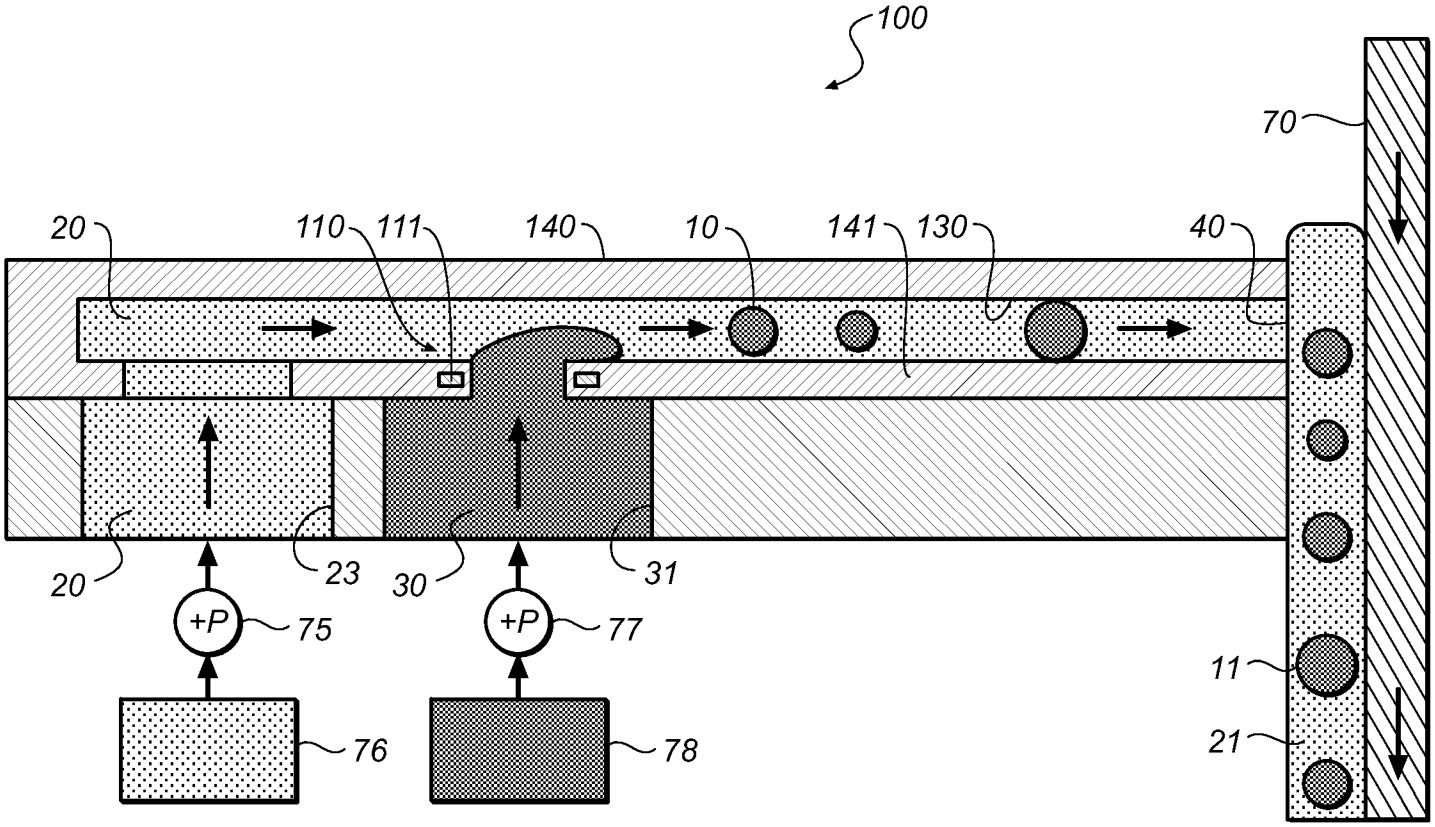
FIG. 1 is a schematic cross sectional side view of a liquid dispenser array showing drop formation of liquid 2 in liquid 1.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide liquid ejection components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the liquid ejection system or the liquid ejection system components described below.

In addition to inkjet printing applications in which the liquid typically includes a colorant for printing an image, the present invention can also be advantageously used in ejecting other types of fluidic materials. Such materials include functional materials for fabricating devices (including conductors, resistors, insulators, magnetic materials, and the like), structural materials for forming three-dimensional structures, biological materials, and various chemicals. The present invention provides sufficient force to eject liquids having a higher viscosity than typical inkjet inks, and does not impart excessive heat into the liquids that could damage them or change their properties undesirably.

Advantageously, fluidic transfer by an example embodiment of the present invention that includes a slot die permits a wide area to be coated simultaneously which results in a very high manufacturing productivity of liquid deposition products when compared to ink jet spraying methods. Another advantage is the ability to create liquid drop patterns in a flow of carrier liquid with example embodiments that include hybrid architectures such as a combination of the slot coating process with offset lithography ink transfer process to create and transfer functional liquid drop patterns to a receiver to permit "digital contact printing" of complex materials. Thus, the present invention combines advantages of ability to digitally control printed pattern in response to a variable input data such as in inkjet printing and high throughput, low cost, reliability, and ink-receiver latitude of contact printing methods such as slot coating and offset lithography.

FIG. 1 shows one configuration of a digital droplet generator, also referred to as a digital contact droplet patterning device. A liquid dispenser array 100 includes of an array of drop formation devices 110, and a liquid dispensing channel 130 and a liquid dispensing channel outlet 40 located between a wall 140 and a liquid dispenser substrate 141. The liquid dispenser array has channels for the controlled flow of liquid 1, the carrier liquid 20, and liquid 2, the functional liquid 30. The action of the drop formation device 110 results in the controllable formation of functional liquid drops 10 which are carried along through the liquid dispensing channel 130 by the movement of the carrier liquid 20 towards the liquid dispensing channel outlet 40. A regulated pressure source 75 in fluid communication with the liquid dispensing channel typically provides a positive pressure that is above atmospheric pressure to pressurize the carrier liquid to cause the carrier liquid to flow through the liquid dispensing channel by way of a liquid supply channel 23. The carrier liquid is initially provided by a liquid supply 76.

A second liquid supply 78 is in liquid communication with liquid dispensing channel 130 through second liquid supply channel 31. The second liquid supply provides the functional liquid to liquid dispensing channel 130. During operation, the functional liquid is periodically pressurized, typically, above atmospheric pressure, by a second regulated pressure source 77, for example, a pump, to form a bulge of the second liquid in liquid dispensing channel 130. A drop formation device 110 associated with the interface of the second liquid supply channel and liquid dispensing channel 130 is actuated to cause a drop of the functional liquid to form in the carrier liquid that is flowing through liquid dispensing channel 130. The drop formation device 110 includes one or more drop forming transducers 111 which can be controlled digitally in response in input print data. As shown in FIG. 1, drop forming transducer 111 is positioned at the interface of liquid dispensing channel 130 and liquid supply channel 31.

Focusing now on the drop formation device 110, the pressure on the carrier liquid inlet and functional liquid inlet are adjusted to create a meniscus of a radius of curvature r that balances the pressure P1 at the carrier liquid side of the meniscus and pressure P2 at the functional liquid side of the meniscus with an interfacial surface tension (γ) between the two phases as $$P2 - P1 = \frac{2\gamma}{r}.$$

By adjusting P1, P2 or γ, it is possible to disturb the force balance at the meniscus and change the radius of curvature. This can be achieved with a fluidic transducer 111. When functional liquid protrudes sufficiently in the carrier liquid flow the shear forces are sufficient to overcome the surface tension forces to break a functional liquid drop from the nozzle which then flows in the carrier liquid. Thus, by controlling the fluidic transducer 111, one can digitally generate drops of functional liquid 30 on-demand based on input data. Choices for transducers are wide ranging and include those to control interfacial surface tension, liquid viscosities, liquid pressures or flow rates, local shear rate, phase change in carrier liquid (bubble), or geometry modulation. As shown in FIG. 1, drop formation device is used to control not only the pattern of the functional liquid drops but also the size of the drops. In the present invention, drop size can be controlled during a drop dispensing operation by changing the stimulation signal provided to the drop formation device 110 by a controller (not shown). For example, the magnitude or the duration of the stimulation signal can be varied in order to change or control the drop size of the functional liquid.

A model of continuous dripping mode drop formation of functional liquid in a cross shear flow of carrier liquid has been described in Universal Dripping and Jetting in a Transverse Shear Flow, Robert F. Meyer and John C. Crocker, Phys. Rev. Lett. 102, 194501 (2009), (hereinafter "Meyer and Crocker"). The model equates the drag force on the liquid meniscus of the functional liquid caused by the flow of the carrier liquid to the surface tension force between interfaces of two liquids that opposes formation. As the shape of the meniscus determines the drag force, the size of the functional liquid channel (orifice) $D_0$, the pressures P1 and P2 or a steady carrier liquid and functional liquid flow rates Q1 and Q2 are important in determining the drop formation.

The frequency of drop formation depends on the flow rate Q1. The viscosity of the functional liquid is important in determining if a functional liquid drop is created or it flows in the form of a sheet. Meyer and Crocker also show that the size of the functional liquid drop is determined by the size of the functional liquid channel $D_0$. This is because the walls in the liquid dispense chamber are sufficiently away from the liquid meniscus and do not affect the fluid dynamics of drop formation.

Once the functional liquid drops 10 are formed and transported by the carrier liquid 20 to the liquid dispensing channel outlet 40, the liquids are transferred to a receiver 70. The receiver can be a web, media or an intermediate, as will be shown in subsequent embodiments. The deposited liquid forms a deposited layer including of dispensed functional liquid drops 11 and dispensed carrier liquid 21. In some embodiments, the dispensed carrier liquid can form part of pattern that is deposited on the receiver along with the functional liquid. The dispensed carrier liquid can be dried or removed by other apparatus discussed below which results in a patterned deposition of functional liquid. Typically, the functional liquid itself is also dried or fixed using other conventional devices or techniques such as, for example, devices or techniques that include radiation or heat cross-linking.

Figure 2:
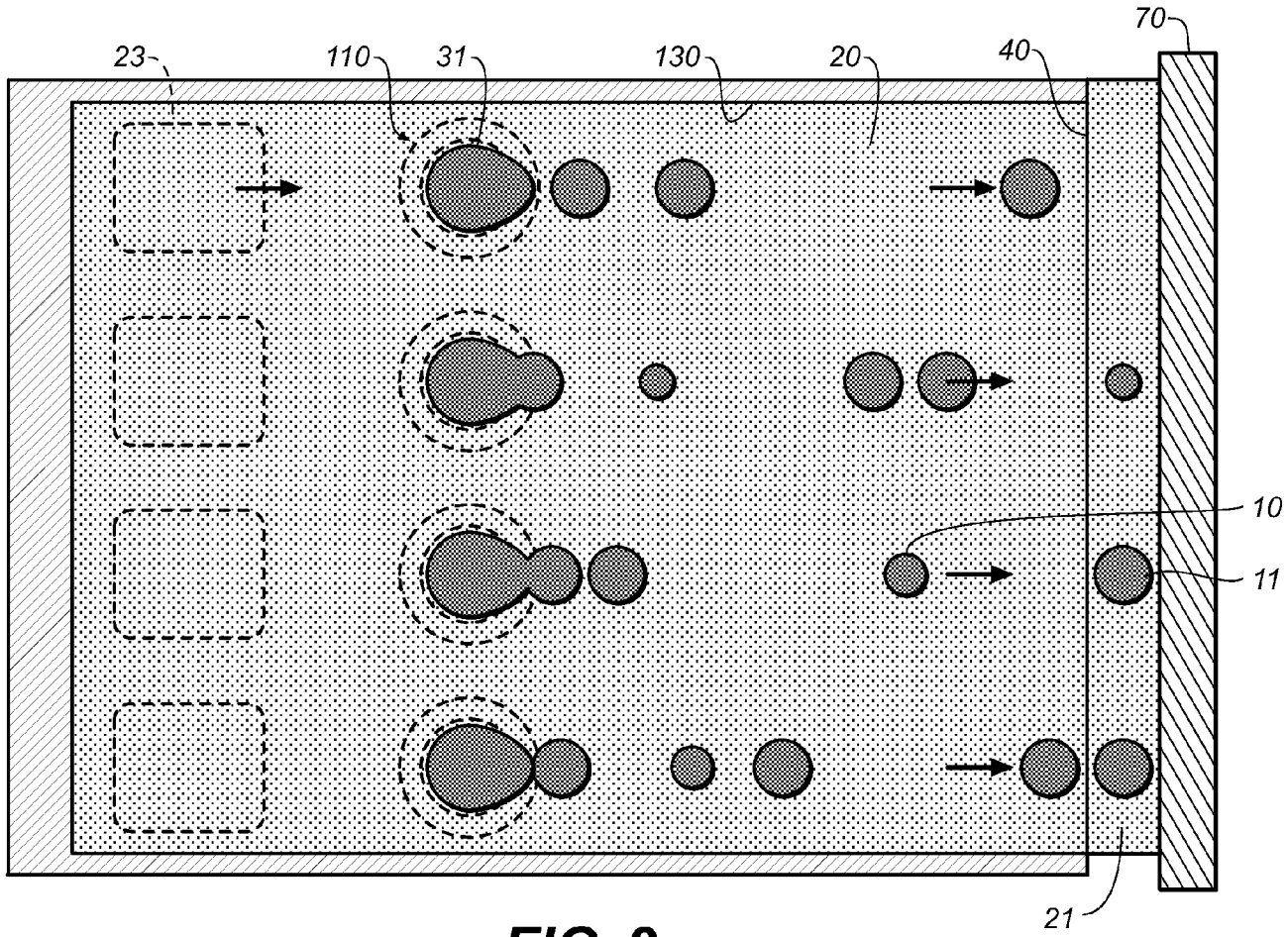
FIG. 2 is a schematic top view of a liquid dispenser array showing a plurality of drop formation devices.

FIG. 2 shows a top view of the liquid dispenser array 100, showing the lateral arrangement of the carrier liquid inlets the functional liquid inlets and the drop formation devices. As FIG. 2 shows, the time controlled formation of functional liquid drops and the motion of the carrier liquid results in a two-dimensional pattern of functional liquid drops that is transferred to the receiver 70 resulting in a patterned deposition. Liquid dispenser array 100 includes a plurality of drop formation devices 110. Typically, the plurality of drop formation devices 110 is arranged in an array, for example, a linear array that is perpendicular to the direction of liquid flow through the liquid dispenser array 100. It should be noted that although a linear array of the drop formation devices 110 is shown in FIG. 2, drop formation devices can be arranged to form any arbitrary pattern in the liquid dispense channel 130. For example, drop formation devices 110 can be arranged in a linear array at an angle to the carrier liquid flow in the dispense channel to create a high resolution pattern or drop formation devices 110 can be arranged in two or more groups arranged in lines and separated in their location along the liquid dispense channel. As shown in FIG. 2, liquid dispenser array 100 includes a plurality of carrier liquid inlets 23 arranged in a one to one corresponding relationship with a plurality of functional liquid inlets 31. In other example embodiments of the invention, the relationship between carrier liquid inlets 23 and functional liquid inlets 31 can be something other than one to one. For example, carrier liquid inlet 23 can be common (say, in the form of a channel) to the plurality of functional liquid inlets 31. Alternatively, the relationship of carrier liquid inlets 23 to functional liquid inlets 31 can be one to two, one to three, or one to four depending on the application contemplated.

Figure 3:
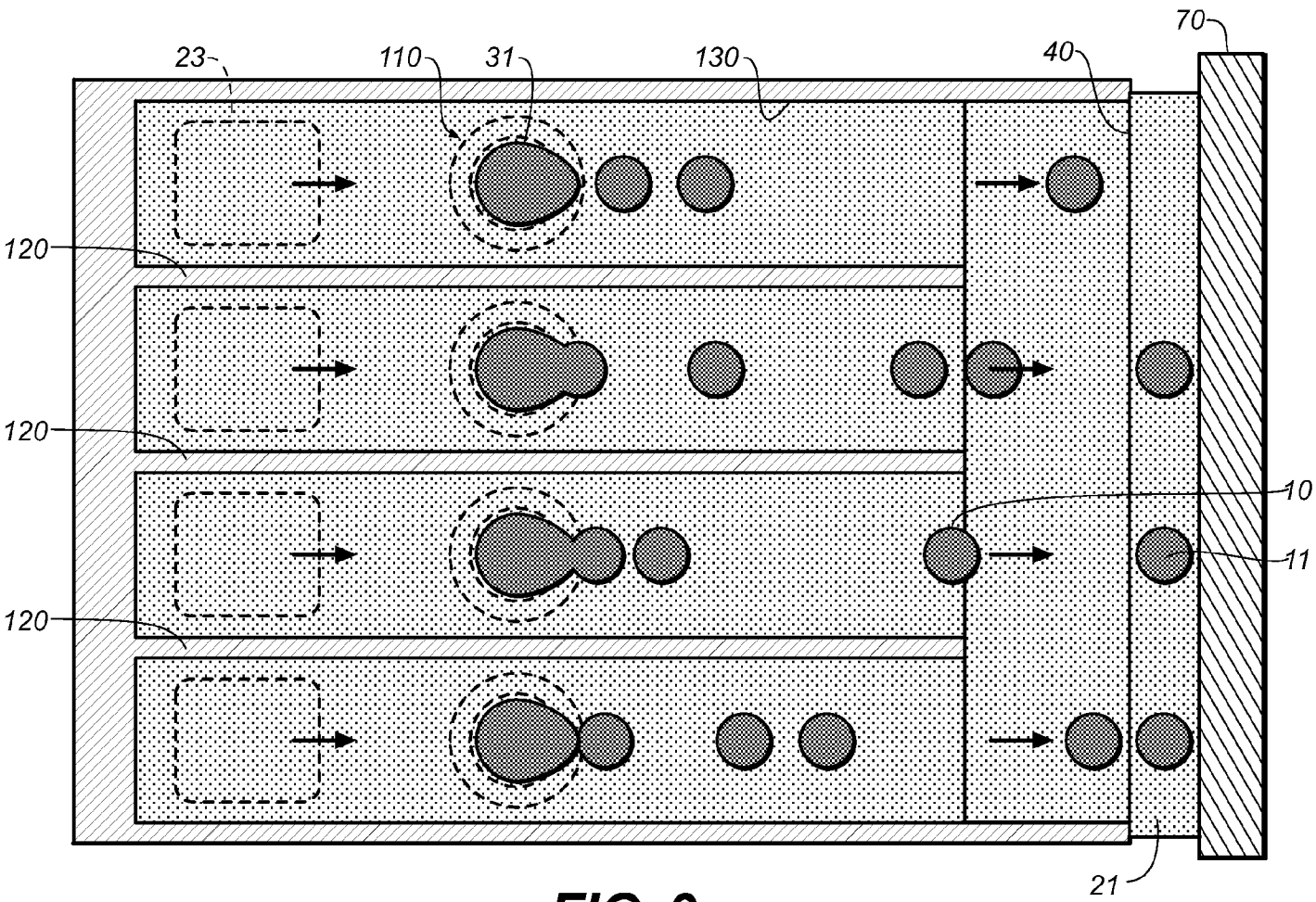
FIG. 3 is a schematic top view of a liquid dispenser array showing walls separating the array of drop formation devices.

FIG. 3 shows a top view of the liquid dispenser array 100 and includes the lateral arrangement of the carrier liquid inlets, the functional liquid inlets, and the drop formation devices. Walls 120 separating the plurality of liquid dispensing channels have been added to enhance the separation of the time controlled formation of functional liquid drops and the two-dimensional pattern of functional liquid drops that is transferred to the receiver 70 resulting in a patterned deposition.

Figure 4:
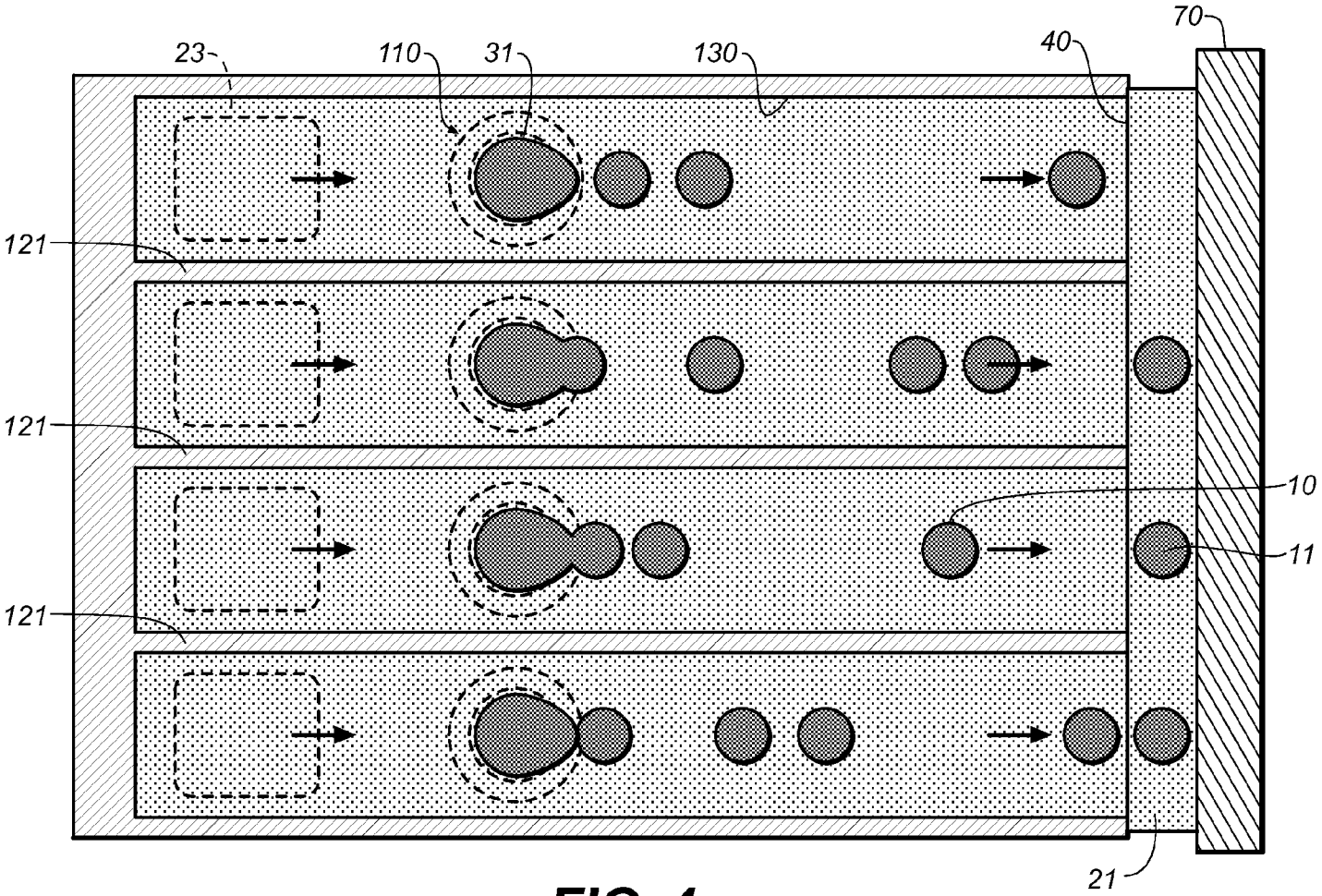
FIG. 4 is a schematic top view of a liquid dispenser array showing walls separating the drop formation devices and dispensing channels.

FIG. 4 shows a top view of the liquid dispenser array 100, showing the lateral arrangement of the carrier liquid inlets, the functional liquid inlets and the drop formation devices. Walls 121, which extend all the way to the liquid dispensing channel outlet, separate the plurality of liquid dispensing channels and enhance the separation of the time controlled formation of functional liquid drops and the two-dimensional pattern of functional liquid drops that is transferred to the receiver 70 resulting in a patterned deposition.

Figure 5:
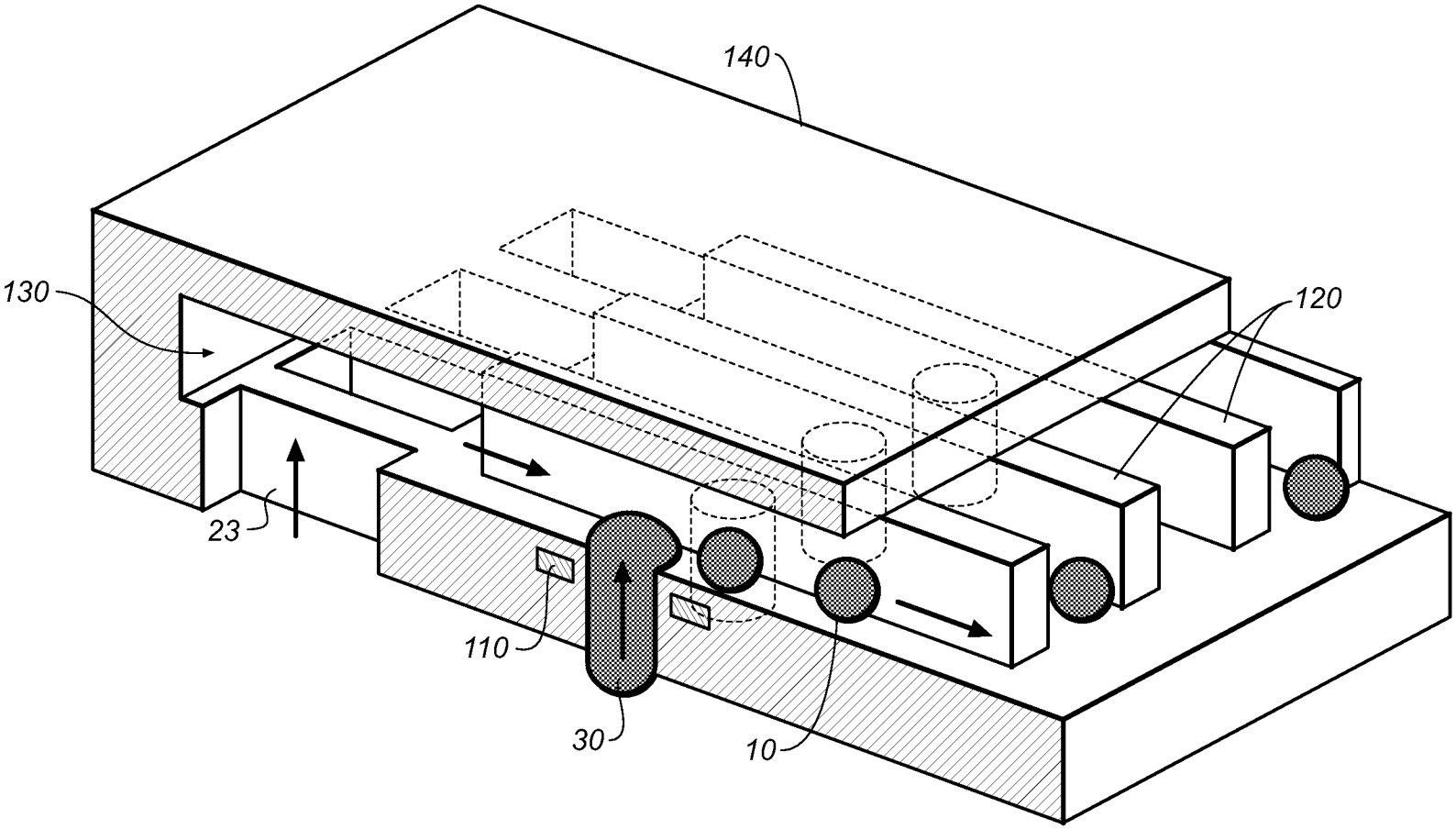
FIG. 5 is a schematic perspective view of a liquid dispenser array showing walls separating the array of drop formation devices.

FIG. 5 shows a perspective view of the liquid dispenser array 100 to further clarify the arrangement of parts.

Figure 6:
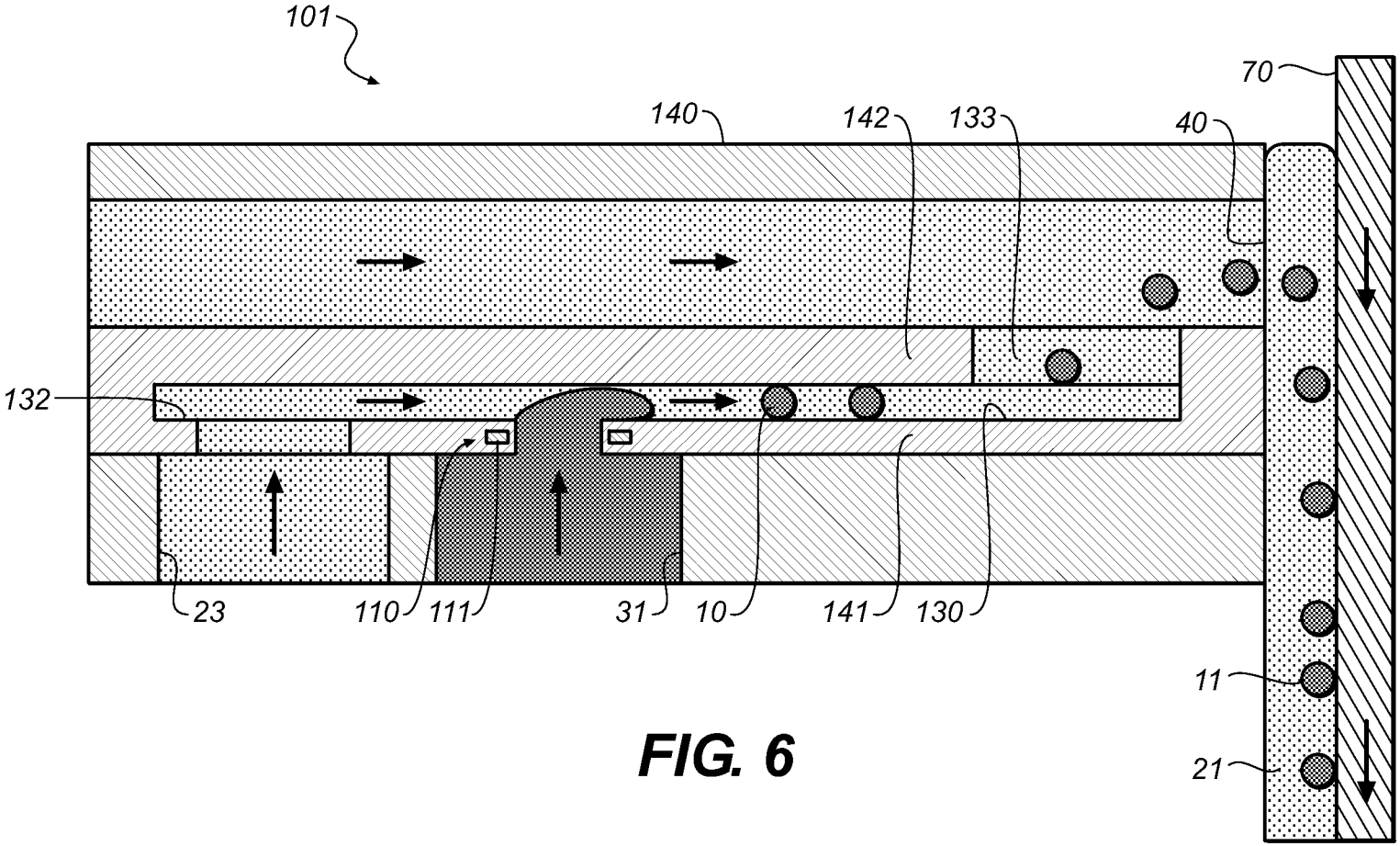
FIG. 6 is a schematic cross sectional side view of an alternative embodiment of a liquid dispenser array in which the drop formation area is constrained by a drop formation wall.

As stated earlier, if the walls in the liquid dispense chamber are sufficiently away from the liquid meniscus and do not affect the fluid dynamics of drop formation size of the functional liquid drop, the size of the functional liquid droplet is determined by the size of the functional liquid channel $D_0$ and physical properties of the two liquid. However, if liquid dispensing channel size is on the same order of magnitude as the orifice and formed drops, the drag force on the liquid drop is modified. As the flow of the carrier liquid and growth of the meniscus between the carrier liquid and functional liquid are restricted by the walls of the liquid dispense channel, it is possible to create functional liquid drops of smaller size. FIG. 6 shows an alternative embodiment of the digital droplet generator, the liquid dispenser array 101, which includes of an array of drop formation devices 110 that are fluidly connected to the drop formation channel 132. The drop formation channel is formed by the space between the liquid dispenser substrate 141 and the droplet separation wall 142. This design is advantaged for producing small functional liquid drops 10. In other embodiments, walls, for example, walls 120 shown in FIG. 3, can be used to separate the plurality of drop formation channels to further control the size of the functional liquid drops.

In operation the droplet formation is controlled by the drop formation device transducer 111. Choices for transducers are wide ranging and include those to control interfacial surface tension, liquid viscosity, liquid pressure or flow rate, local shear rate, phase change in carrier liquid (bubble), or geometry modulation. The small drops formed in the carrier liquid then flow through the drop formation channel 132 to the liquid dispensing transfer outlet 133 to transfer the drops to the liquid dispensing channel 130 where additional dispensing liquid 131 is flowing. The action of the drop formation device 110 results in the controllable formation of functional liquid drops 10 which are carried along through the liquid dispensing channel 130 by the movement of the carrier liquid 20 towards the liquid dispensing channel outlet 40.

Figure 7:
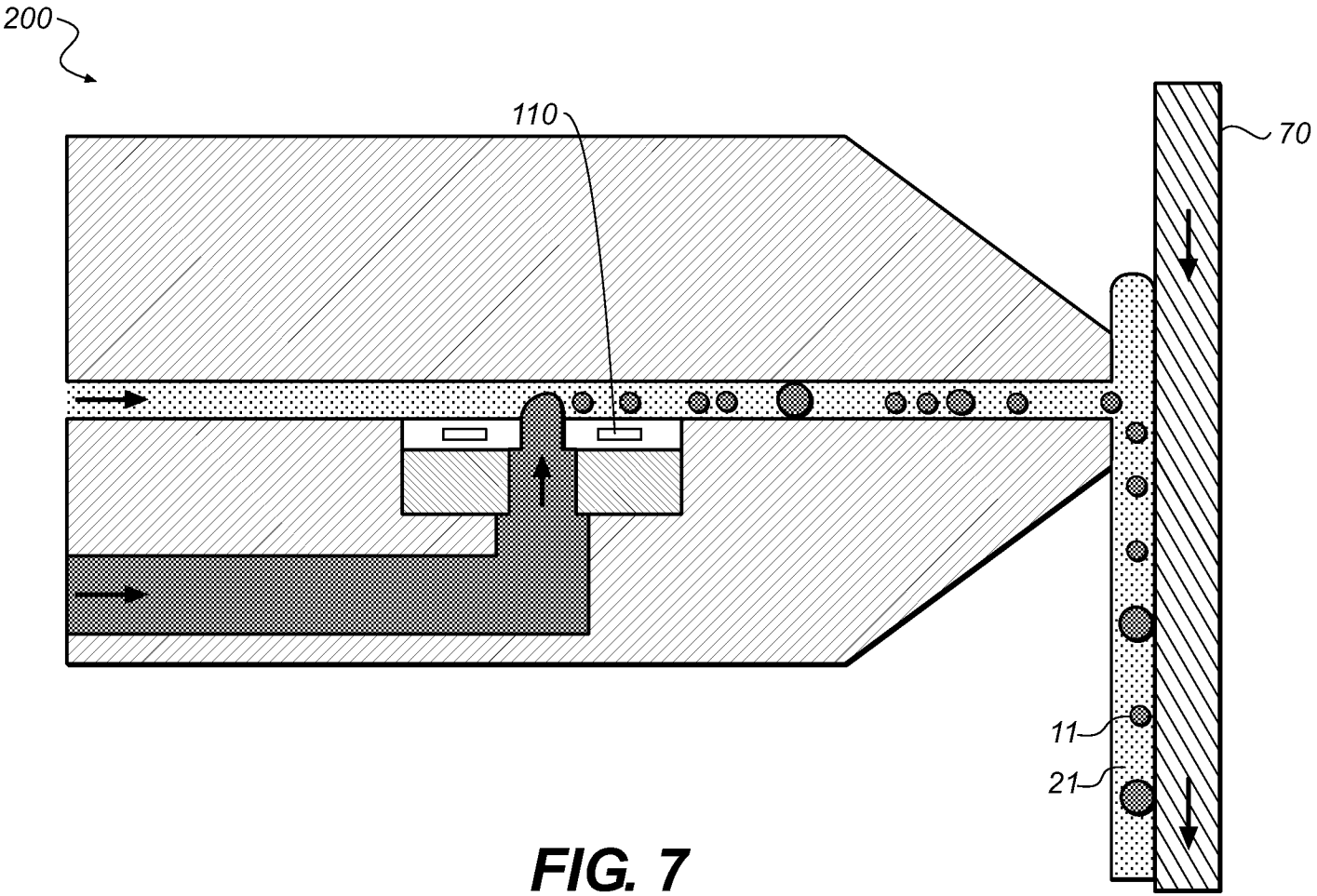
FIG. 7 is a schematic cross sectional side view of a liquid dispenser array in a slot die device that dispenses liquid 2 drops in liquid 1 onto a receiver.

FIG. 7 shows the liquid dispenser array embedded in a slot die device 200. This configuration of the present invention can be referred to as a digital slot coating die. This houses and positions the liquid dispensing channel outlet relative to the media receiver 70 that is receiving the dispensed functional liquid drops 11 carried by the dispensed carrier liquid 21. As shown in FIG. 7, drop formation device is used to control not only the pattern of the functional liquid drops but also the size of the drops. When the stimulation signal provided to the plurality of drop formation devices 110 is constant, walls 142 (or walls 120, or a combination of both walls 142 and 120) limit the drop size by controlling the amount of functional liquid that accumulates prior to actuation of drop formation device 110. The slot die system is a preferred example embodiment, capable of very high speed and high quality coating on to a continuously moving receiver, but is only representative of one of several ways to position the liquid dispensing array relative to the coated receiver.

Figure 8:
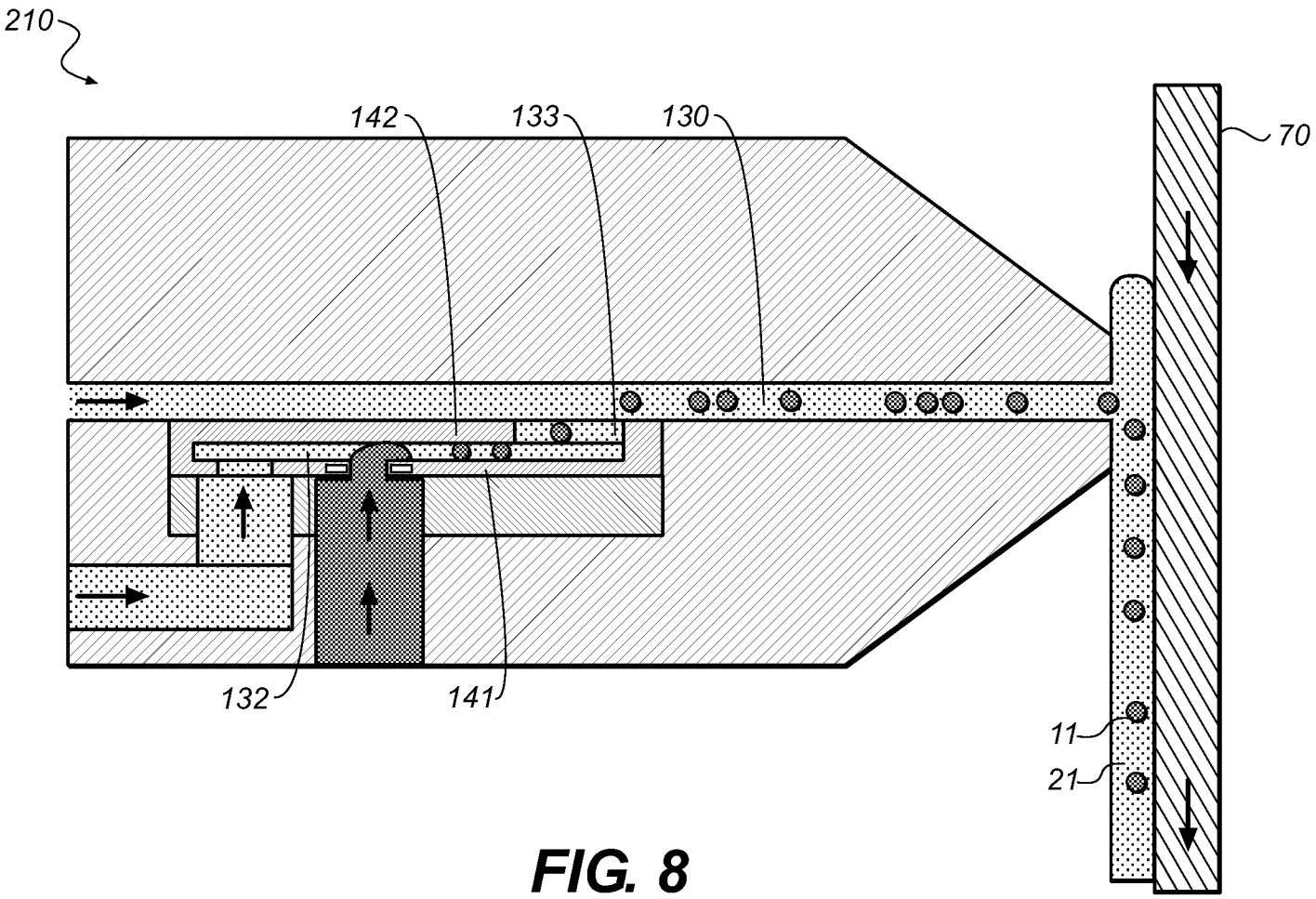
FIG. 8 is a schematic cross sectional side view of an alternative embodiment of a liquid dispenser array in a slot die device that dispenses liquid 2 drops in liquid 1 onto a receiver.

FIG. 8 shows the liquid dispenser array with the alternative embodiment, which includes of an array of drop formation devices 110 that are in fluidic communication with the drop formation channel 132. This configuration of the present invention can also be referred to as a digital slot coating die. The drop formation channel being formed by the space between the liquid dispenser substrate 141 and the droplet separation wall 142. The small drops formed in the carrier liquid then flow through the drop formation channel 132 to the liquid dispensing transfer outlet 133 to transfer the drops to the liquid dispensing channel 130 embedded in a slot die device 210. This houses and positions the liquid dispensing channel outlet relative to the media receiver 70 that is receiving the dispensed functional liquid drops 11 carried by the dispensed carrier liquid 21.

In the arrangements shown in FIGS. 1-8, the carrier liquid not only assists in metering and transporting functional liquid drops to the receiver but also prevents a direct contact of functional liquid with surrounding air. This feature is very useful in improving reliability of functional liquid drop dispenser by preventing drying of functional liquid, for example, ink, which can result in clogging of one or more regions of liquid supply channel, second liquid supply channel, and liquid dispensing channel. Similarly, the carrier liquid also prevents a direct contact of the functional liquid drops to walls of the liquid dispense array. This helps in avoiding adhesion of the functional liquid to one or more regions of liquid supply channel and liquid dispensing channel. Such adhesion can also cause clogging the dispensing structure.

Figure 9:
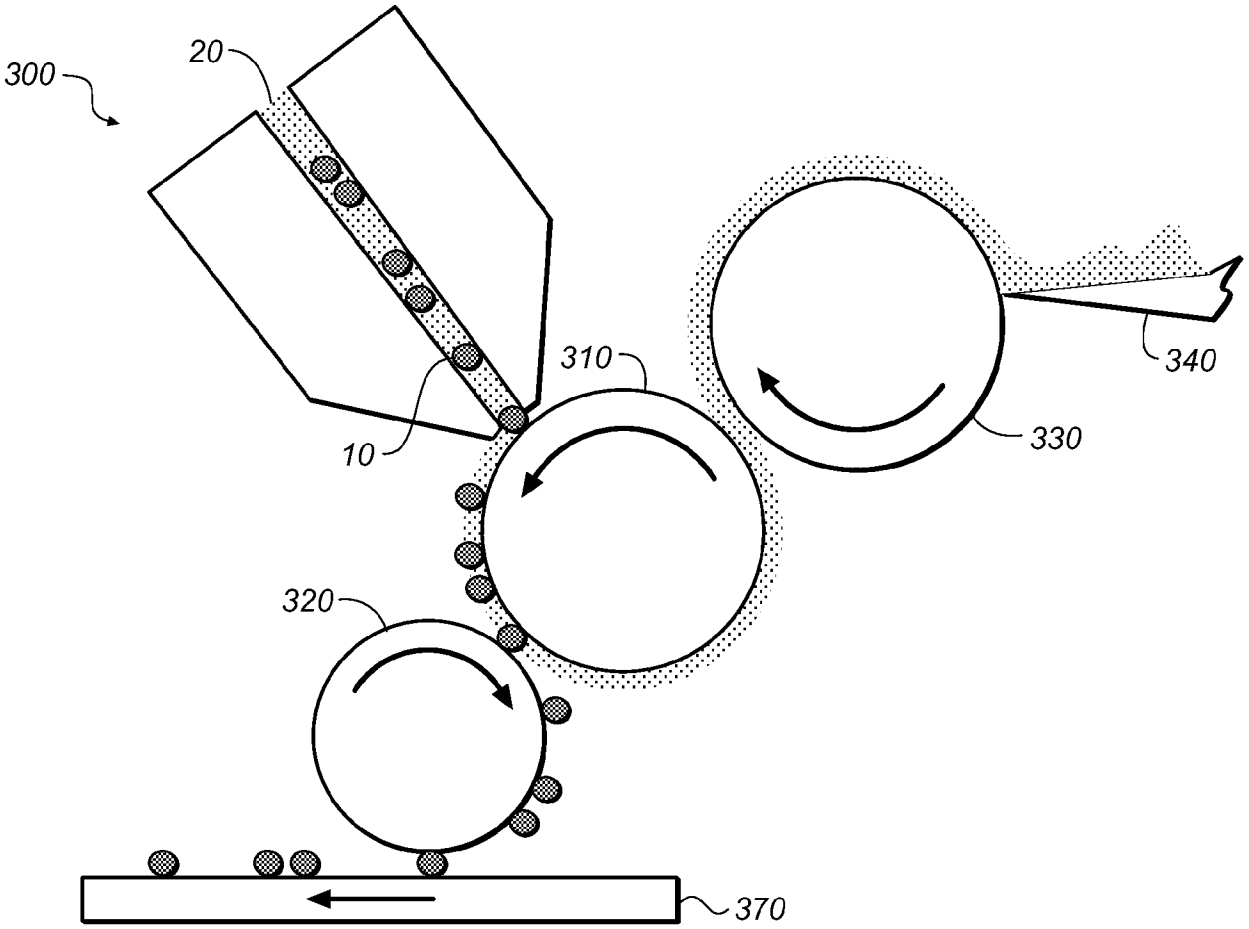
FIG. 9 is a side view of a liquid dispensing system including a liquid dispenser array in a slot die device and an offset roller configuration that transfers only liquid 2 to a receiver.

FIG. 9 shows the liquid dispenser array in a slot die mechanism depositing the dispensed functional liquid drops 11 carried by the dispensed carrier liquid 21 into an transfer roller system 300 capable of reducing or largely eliminating the carrier liquid prior to the final deposition of the functional liquid onto the receiver 370. This example embodiment of the present invention can be referred to as a digital offset lithographic device. The dispensed functional liquid drops 11 carried by the dispensed carrier liquid 21 are deposited onto the first transfer roller 310 that is in contact with a second transfer roller 320 and a liquid carrier roller 330. The properties of roller 310, 320 and 330 are such that the carrier liquid is preferentially transferred to the liquid carrier roller 330 and the functional liquid in preferentially transferred to the second transfer roller 320. For example, roller 310 can have a high resolution patterned surface to selectively attach functional liquid drops while repelling the carrier liquid. This can be achieved by patterning the roller 310 with hydrophilic/hydrophobic sites. When roller 310 includes a patterned or textured surface having a resolution that is greater than or equal to the resolution of the drop formation devices 110, the likelihood of unintended drop migration during the function drop transfer process is reduced. Similarly, roller 320 can be coated with a material to collect functional liquid, for example, ink, drops and roller 330 can be coated to create a surface to collect carrier liquid. Excess liquid is removed from the liquid carrier roller by, for example, a skive 340. The second transfer roller 320 carries the concentrated functional liquid to the receiver where the functional drops are transferred with little or no carrier liquid present. Thus, the embodiment shown in FIG. 9 is a hybrid digital printing apparatus and method that uses a slot coating process and offset lithography transfer process.

Figure 10:
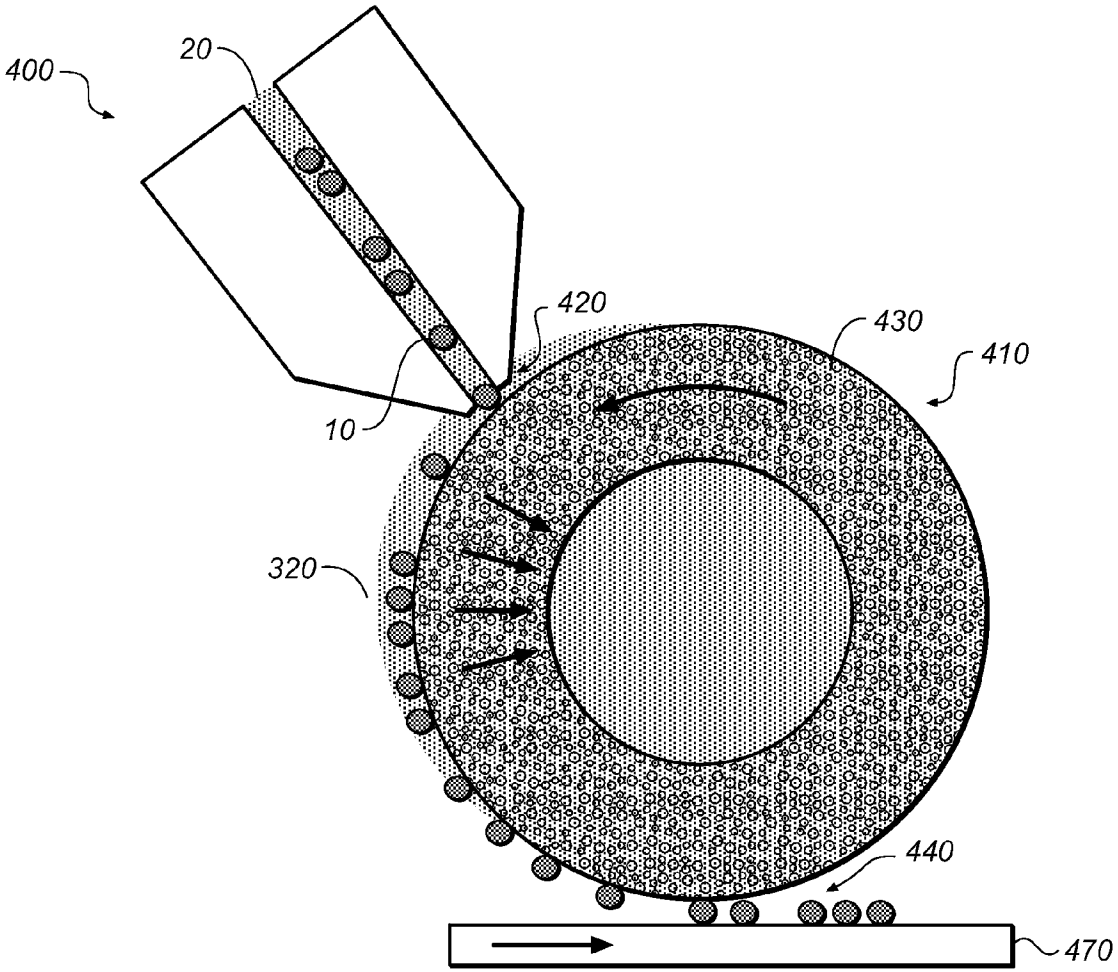
FIG. 10 is a side view of a liquid dispensing system including a liquid dispenser array in a slot die device and an alternative embodiment of a roller configuration that removes liquid 1 and only transfers liquid 2 to a receiver.

FIG. 10 shows an alternate embodiment for a carrier liquid removal system 400 including of carrier liquid removal transfer roller 410. The carrier liquid removal transfer roller concentrates the functional liquid after the dispensed functional liquid drops 11 carried by the dispensed carrier liquid 21 are deposited onto the surface of the roller 410 at the location 420. The roller 410 features a porous blanket 430 which is maintained at a negative fluidic pressure, by for example a pump (not shown) to pull the carrier liquid 21 towards the core (as shown by the arrows in FIG. 10). In this manner, carrier liquid is removed resulting in a concentrated functional liquid on the surface of the roller 410 at the nip 440 where the functional drops are then transferred to the receiver 470 with little or no carrier liquid present.

Figure 11:
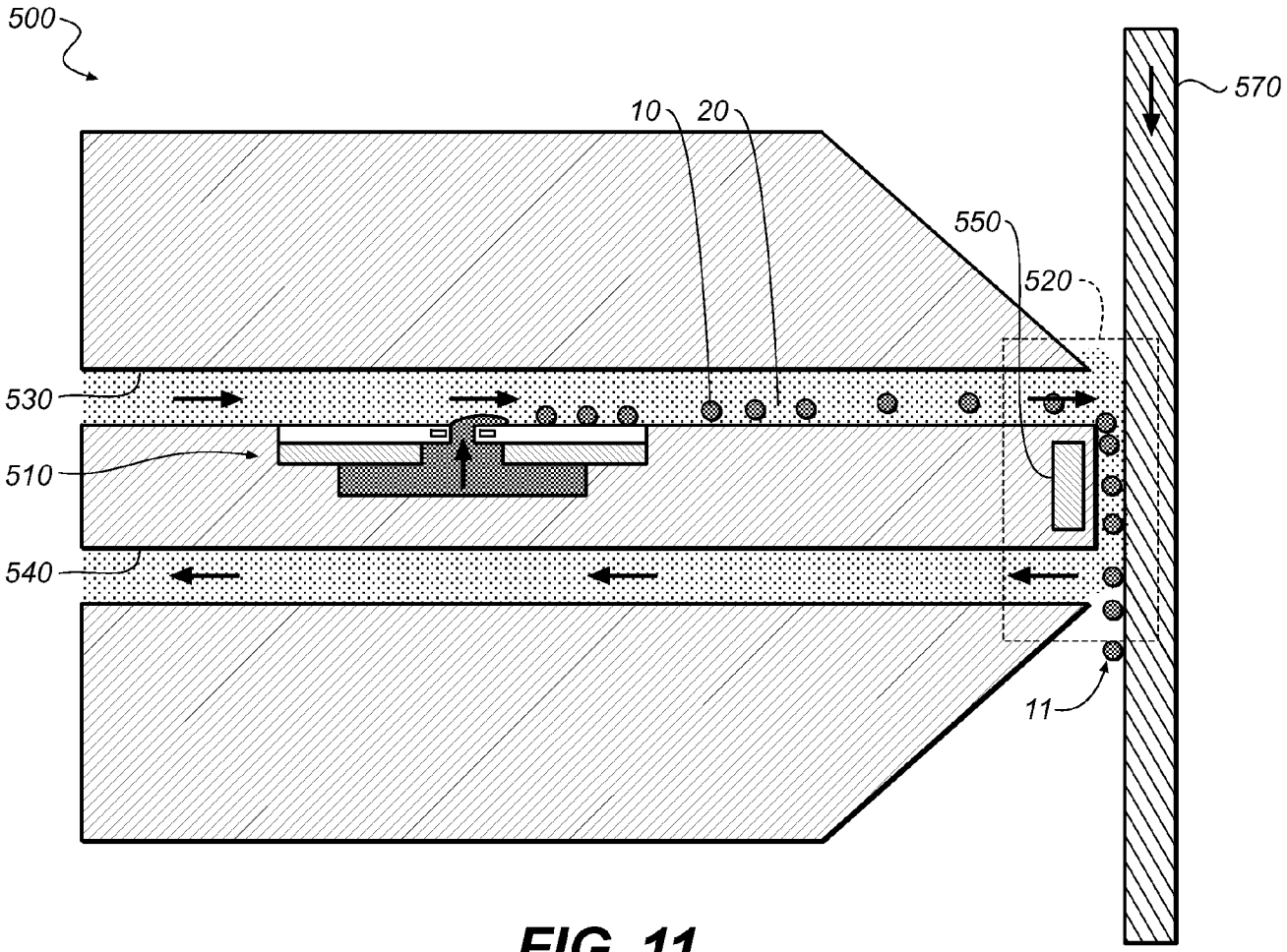
FIG. 11 is a schematic cross sectional side view of a liquid dispenser array in a slot die device that includes a return channel for removing a substantial amount of the liquid 1 from a receiver.

FIG. 11 shows a slot die system 500 with a liquid dispenser array 510, which is capable of producing drops of functional liquid 10 in a carrier liquid 20 that are transported though a liquid dispense channel 530 to a drop transfer zone 520 where the functional liquid drops are deposited on the receiver 570. The embodiment then features a carrier liquid return channel 540, which acts on the liquid deposited onto the receiver 570 in such a way as to remove preferentially the carrier liquid leaving only the transferred functional drops 11.

Figure 12:
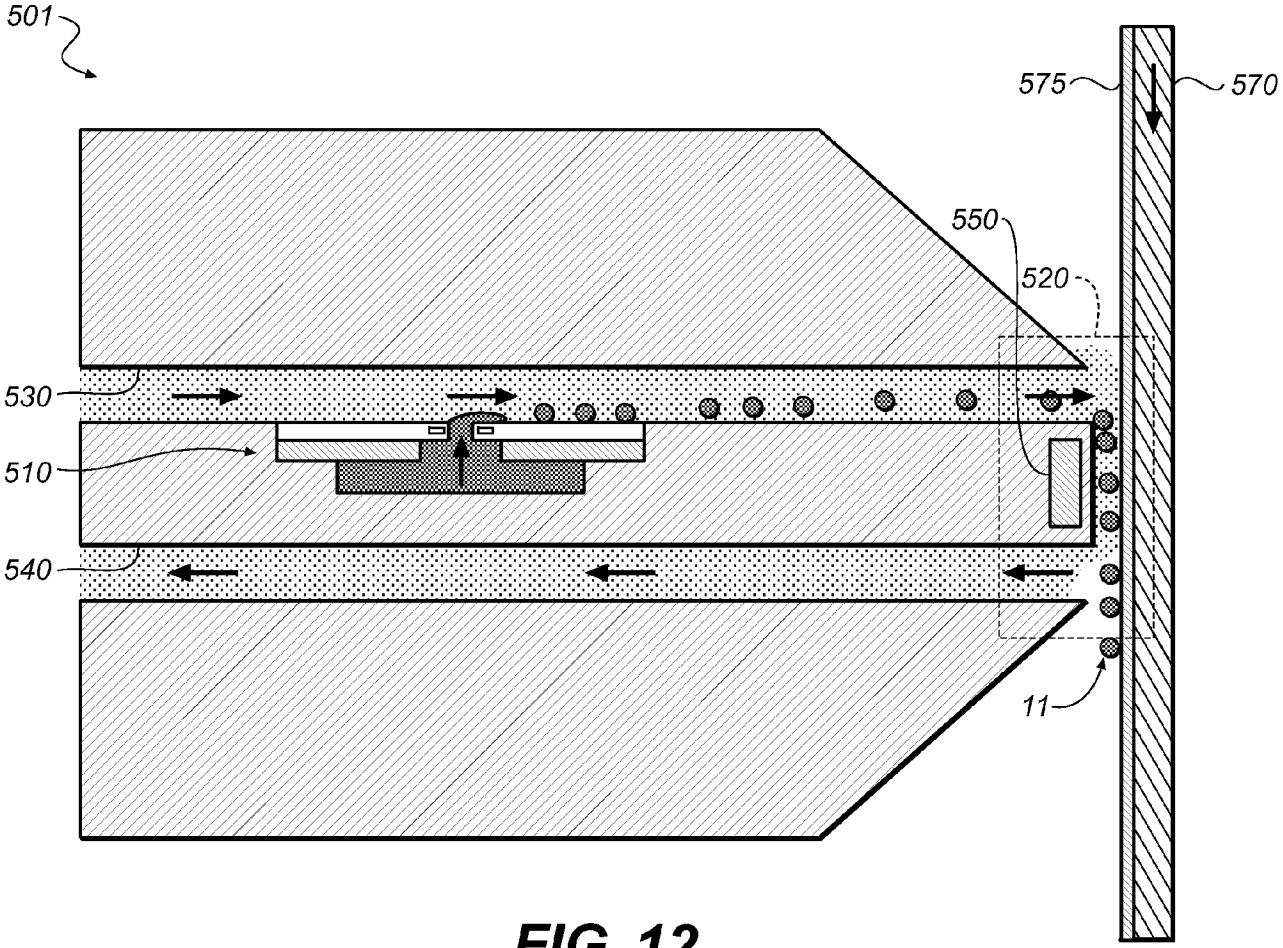
FIG. 12 is a schematic cross sectional side view of a liquid dispenser array in a slot die device including a return channel for removing a substantial amount of the liquid 1 from the receiver and including a drop deflection device for displacing the drops of liquid 2 within liquid 1 when the drop of liquid 2 are in a drop transfer zone.

FIG. 12 shows a slot die system 500 with a liquid dispenser array 510, which is capable of producing drops of functional liquid 10 in a carrier liquid 20 that are transported though a liquid dispense channel 530 to a drop transfer zone 520. In the drop transfer zone there is embedded into the slot die system a drop deflection transducer 550 which causes the functional liquid drops to move to a close relationship to the web/media/receiver/intermediate receiver 570 such that they adhere. Choices for transducers are wide ranging and include electrostatic, electromagnetic, dielectrophoretic and acoustic. The embodiment then features a carrier liquid return channel 540, which acts on the liquid deposited onto the receiver 570 in such a way as to remove preferentially the carrier liquid leaving only the transferred functional drops 11.

In embodiment shown in FIG. 12, the surface of the receiver 570 of the functional liquid drops—web/media/receiver/intermediate, can be pre-coated with one or more layers 575 of adhesion promoting materials to selectively attach the functional liquid drops and/or while not adhering to carrier liquid. In other embodiments, the surface of the receiver 750 can be modified with other surface modification methods such as plasma treatment, electrostatic charging, or heating to promote adhesion of the functional liquid drops to the receiver and/or while not adhering to carrier liquid.

Figure 13:
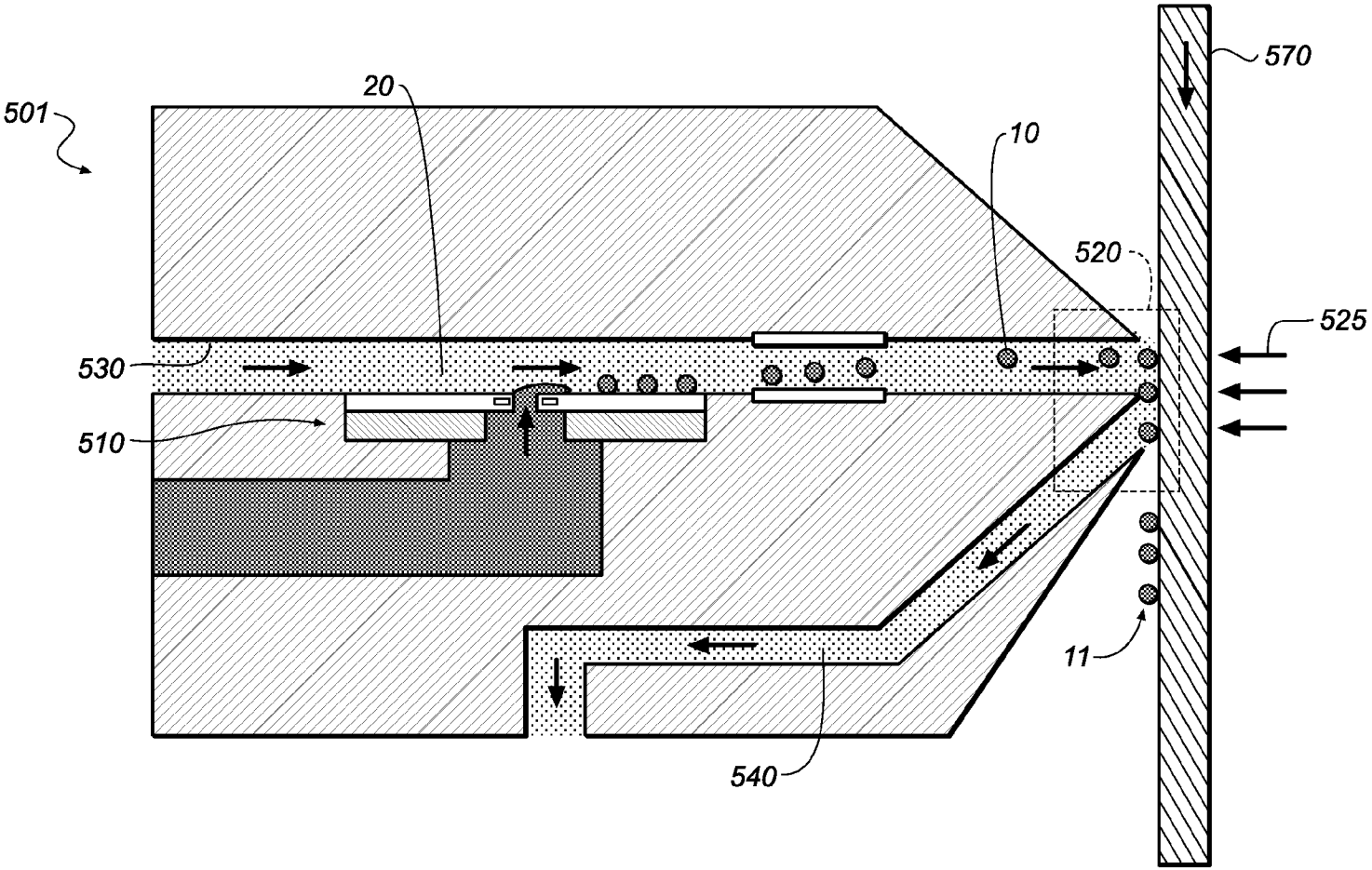
FIG. 13 is a schematic cross sectional side view of a liquid dispenser array in a slot die device including a drop deflection device in a liquid dispensing channel and including a return channel for removing a substantial amount of liquid 1 at a line of deposition of liquid 2 onto a receiver.

FIG. 13 shows a slot die system 501 with a liquid dispenser array 510, which is capable of producing drops of functional liquid 10 in a carrier liquid 20 that are transported though a liquid dispense channel 530 to a drop transfer zone 520. In the liquid dispense channel there is embedded into the slot die system a drop deflection transducer 550 which causes the functional liquid drops to move to apposition that is advantages to produce a close relationship to the web/media/receiver/intermediate receiver 570 in the drop transfer zone such that they adhere. Choices for transducers are wide ranging and include electrostatic, electromagnetic, dielectrophoretic, or acoustic transducers. The embodiment then features a carrier liquid return channel 540, which acts on the carrier liquid to remove preferentially the carrier liquid even before it is deposited onto the receiver 570 in such a way as leaving only the transferred functional drops 11. In other embodiments, external stimulus 525 can be used to promote adhesion of the functional liquid drops to the receiver. For example heat can be used to locally fuse the functional liquid drops in the receiver.

The invention has been described in detail with particular reference to certain preferred embodiments thereof, but it will be understood that variations and modifications can be effected within the scope of the invention.

PARTS LIST

10 functional liquid drops
11 dispensed functional liquid drops
20 carrier liquid
21 dispensed carrier liquid
23 plurality of carrier liquid inlets
30 functional liquid
31 plurality of functional liquid inlets
70 receiver
75 pressure source
76 liquid supply
77 pressure source
78 liquid supply
100 liquid dispenser array
101 liquid dispenser array
110 drop formation devices
111 fluidic transducer
120 walls
121 walls
130 liquid dispensing channel
131 additional dispensing liquid
132 drop formation channel
140 wall
141 liquid dispenser substrate
142 droplet separation wall
200 slot die device
210 slot die device
300 transfer roller system
310 first transfer roller
320 second transfer roller
330 liquid carrier roller
340 skive
370 receiver
400 carrier liquid removal system
410 carrier liquid removal transfer roller
420 location
430 porous blanket
440 nip
470 receiver
500 slot die system
501 slot die system
510 liquid dispenser array
520 drop transfer zone
525 external stimulus
530 liquid dispense channel
540 carrier liquid return channel
550 drop deflection transducer
570 receiver
575 one or more layers
750 receiver

The invention claimed is:

1. A liquid dispensing system comprising:

a liquid dispenser array structure comprising:

a liquid dispensing channel;

a liquid return channel located downstream relative to the liquid dispensing channel;

a functional liquid transfer region located between the liquid dispensing channel and the liquid return channel;

a first liquid supply that provides a carrier liquid that flows continuously through the liquid dispensing channel, through the functional liquid transfer region, and through the liquid return channel during operation;

a plurality of liquid dispensers located on a substrate that is common to the plurality of liquid dispensers, the plurality of liquid dispensers including:

a liquid supply channel;

a second liquid supply that provides a functional liquid to the liquid dispensing channel through the liquid supply channel; and a drop formation device positioned at an interface of the liquid supply channel and the liquid dispensing channel, the drop formation device including a fluidic transducer that is selectively actuated to form on-demand discrete drops of the functional liquid in the carrier liquid flowing through the liquid dispensing channel, the functional liquid being immiscible in the carrier liquid; and a receiver conveyance mechanism, the receiver conveyance mechanism and the functional liquid transfer region being positioned relative to each other such that the discrete drops of the functional liquid are applied to a receiver provided by the receiver conveyance mechanism while the carrier liquid continues to flow through the functional liquid transfer region, and through the liquid return channel.

2. The system of claim 1, further comprising:

a functional liquid drop deflection mechanism positioned in the functional liquid transfer region to deflect the discrete drops of the functional liquid toward the receiver provided by the receiver conveyance mechanism.

3. The system of claim 2, wherein the functional liquid drop deflection mechanism includes one of an electric field deflection mechanism, an acoustic deflection mechanism, a hydraulic deflection mechanism, and a mechanical deflection mechanism.

4. The system of claim 1, further comprising:

a functional liquid drop deflection mechanism positioned in the liquid dispensing channel to deflect the discrete drops of the functional liquid toward the receiver provided by the receiver conveyance mechanism.

5. The system of claim 4, wherein the functional liquid drop deflection mechanism includes one of an electric field deflection mechanism, an acoustic deflection mechanism, a hydraulic deflection mechanism, and a mechanical deflection mechanism.

6. The dispenser array structure of claim 1, wherein the first liquid supply includes a regulated pressure source that is in fluid communication with the liquid dispensing channel.

7. The dispenser array structure of claim 6, wherein the regulated pressure source provides a positive pressure that is above atmospheric pressure.

8. The dispenser array structure of claim 1, wherein the liquid return channel is in fluid communication with a regulated vacuum source.

9. The dispenser array structure of claim 8, wherein the regulated vacuum source provides a vacuum pressure that is below the atmosphere pressure.

* * * * *